US008866385B2

(12) United States Patent
Kitagawa et al.

(10) Patent No.: US 8,866,385 B2
(45) Date of Patent: Oct. 21, 2014

(54) SELF-BALLASTED LAMP AND LIGHTING FIXTURE

(75) Inventors: Toshitake Kitagawa, Yokosuka (JP); Makoto Sakai, Yokosuka (JP); Daigo Suzuki, Yokohama (JP); Michinobu Inoue, Yokohama (JP)

(73) Assignees: Toshiba Lighting & Technology Corporation, Kanagawa (JP); Kabushiki Kaisha Toshiba, Toyko (JP)

( * ) Notice: Subject to any disclaimer, the term of this patent is extended or adjusted under 35 U.S.C. 154(b) by 481 days.

(21) Appl. No.: 13/222,837

(22) Filed: Aug. 31, 2011

(65) Prior Publication Data

US 2012/0049737 A1 Mar. 1, 2012

(30) Foreign Application Priority Data

Aug. 31, 2010 (JP) ..... 2010-195001

(51) Int. Cl.

| | |
|---|---|
| ***H01J 7/44*** | (2006.01) |
| ***F21V 3/02*** | (2006.01) |
| ***F21K 99/00*** | (2010.01) |
| ***F21V 17/10*** | (2006.01) |
| ***F21V 23/00*** | (2006.01) |
| *F21V 3/00* | (2006.01) |
| *F21V 5/04* | (2006.01) |
| *F21Y 101/02* | (2006.01) |

(52) U.S. Cl.

CPC ..... *F21V 17/101* (2013.01); *F21V 3/00* (2013.01); *F21V 5/04* (2013.01); *F21Y 2101/02* (2013.01); *F21K 9/135* (2013.01); *F21V 23/006* (2013.01); *F21K 9/50* (2013.01)

USPC ..... 315/51; 313/318.01; 362/310; 362/363

(58) Field of Classification Search

CPC ..... H05B 37/00; H01J 7/44; F21V 3/02; F21V 5/00; F21V 5/04; F21V 17/00; F21V 17/10; F21V 17/101; F21V 7/00; F21V 17/12; F21V 17/16; F21V 19/00; F21V 19/001; F21K 9/00

USPC ..... 362/257, 296.01, 307, 310, 308, 362/296.02, 296.03, 296.04, 317, 326, 341, 362/351, 362, 363, 368, 364, 365; 313/110, 313/113, 116, 317, 318.01, 318.02, 318.03, 313/318.07, 318.04; 315/291, 71, 363, 56, 315/51

See application file for complete search history.

(56) References Cited

U.S. PATENT DOCUMENTS

| | | | |
|---|---|---|---|
| 6,803,607 | B1 | 10/2004 | Chan |
| 2004/0228131 | A1 | 11/2004 | Minano |

(Continued)

FOREIGN PATENT DOCUMENTS

| | | |
|---|---|---|
| CN | 201237199 | 5/2009 |
| CN | 201487618 | 5/2010 |

(Continued)

OTHER PUBLICATIONS

CN201487618U, May 26, 2010, translation.*

(Continued)

*Primary Examiner* — David H Vu

(74) *Attorney, Agent, or Firm* — DLA Piper LLP (US)

(57) ABSTRACT

A self-ballasted lamp includes a base body, a light source unit attached to one side of the base body, a lens attached to the light source unit, a cap provided on the other side of the base body and a lighting circuit arranged in the space provided by the base body and the cap. The light source unit includes a light source constituted by semiconductor light emitting elements. The lens has a lens body facing the light source and an attachment leg for attaching the lens body to the light source unit. A claw portion to be secured to the light source unit can be provided on the attachment leg.

6 Claims, 5 Drawing Sheets

(56) References Cited

U.S. PATENT DOCUMENTS

| | | | | |
|---|---|---|---|---|
| 2009/0067179 | A1 | 3/2009 | Chaves | |
| 2011/0234082 | A1* | 9/2011 | Cao | 313/318.01 |
| 2011/0298371 | A1* | 12/2011 | Brandes et al. | 315/32 |

FOREIGN PATENT DOCUMENTS

| | | |
|---|---|---|
| DE | 102008055936 | 5/2010 |
| EP | 2112424 | 10/2009 |
| JP | 2006-156187 | 6/2006 |

OTHER PUBLICATIONS

CN201237199Y, May 13, 2009, translation.*
European Search Report issued in EP 11178974 on Dec. 5, 2012.
Chinese Office Action issued in CN 201110305867.4 on Aug. 29, 2013.
English Language Translation of Chinese Office Action issued in CN 201110305867.4 on Aug. 29, 2013.
English Language Abstract for CN 201487618 published on May 26, 2010.
Chinese Office Action issued in CN 201110305867.4 on Feb. 17, 2014.
English Language Translation of Chinese Office Action issued in CN 201110305867.4 on Feb. 17, 2014.
English Language Abstract of DE 102008055936 published on May 6, 2010.
European Office Action issued in EP 11178974.9 on Mar. 31, 2014.
English Language Abstract of EP 2112424 published on Oct. 28, 2009.
Japanese Office Action issued in JP 2010-195001 on May 21, 2014.
English Language Translation of Japanese Office Action issued in JP 2010-195001 on May 21, 2014.
English Language Abstract and Translation of JP 2006-156187 published on Jun. 15, 2006.

* cited by examiner

SELF-BALLASTED LAMP AND LIGHTING FIXTURE

INCORPORATION BY REFERENCE

The present invention claims priority under 35 U.S.C. §119 to Japanese Patent Application No. 2010-195001 filed on Aug. 31, 2010. The content of the application is incorporated herein by reference in its entirety.

FIELD

Embodiments described herein relate generally to a self-ballasted lamp using semiconductor light emitting elements as a light source, and a lighting fixture using the self-ballasted lamp.

BACKGROUND

A self-ballasted lamp using LED elements as a light source may be interchangeable with an incandescent lamp. In the self-ballasted lamp, a substrate is mounted on one end surface of a base body, and a globe is attached to one end of the base body. LED elements are mounted on the substrate to form a light source. The globe covers the light source.

Generally, the incandescent lamp has wide-angle light distribution performance with high luminous intensities in an optical axis direction and a direction orthogonal to the optical axis direction. However, the self-ballasted lamp has light distribution performance with high luminous intensity in an optical axis direction opposite to a front surface of the light source and luminous intensity in a direction orthogonal to the optical axis direction. Accordingly, the self-ballasted lamp is unsuitable for some kinds of lighting fixtures.

For some applications it is desirable for the self-ballasted lamp to have wide-angle light distribution performance with high luminous intensities in an optical axis direction and a direction orthogonal to the optical axis direction, similar to an incandescent lamp. Although the globe covering the light source in the self-ballasted lamp is frequently diffusive, the diffusion by the globe may not improve luminous intensity in the direction orthogonal to the optical axis direction to a sufficient degree.

To address this issue, a self-ballasted lamp may include a lens facing a light source arranged to reflect light, which advances from the light source in an optical axis direction, in a direction orthogonal to the optical axis direction so that luminous intensity in the direction orthogonal to the optical axis direction is increases.

However, when a lens is used for a self-ballasted lamp, the lens cannot be easily arranged to face a light source, and a positional relationship between the lens and the light source cannot be adjusted. Therefore, uneven light distribution performance may be observed.

It is an object of the present invention to provide a self-ballasted lamp which can easily arrange a lens facing a light source, adjust a positional relationship between the light source and the lens, and stabilize light distribution performance, and a lighting fixture using the same.

DETAILED DESCRIPTION

According to one embodiment, a self-ballasted lamp of an embodiment includes a base body, a light source unit attached to one side of the base body, a lens attached to the light source unit, a cap provided on the other end side of the base body and a lighting circuit arranged in the space provided by the base body and the cap. The light source unit includes a light source constituted by semiconductor light emitting elements. The lens has a lens body facing the light source and a pair of attachment legs for attaching the lens body to the light source unit, and a claw portion to be secured to the light source unit is provided on each attachment leg.

According to the self-ballasted lamp, since the claw portion on the attachment legs of the lens is secured to the light source unit, the lens can be easily arranged in the light source unit so that the lens body of the lens is arranged facing the light source of the light source unit, a positional relationship between the light source and the lens can be adjusted and light distribution performance can be stabilized.

Next, the embodiment will be described with reference to the drawings.

Figure 1:
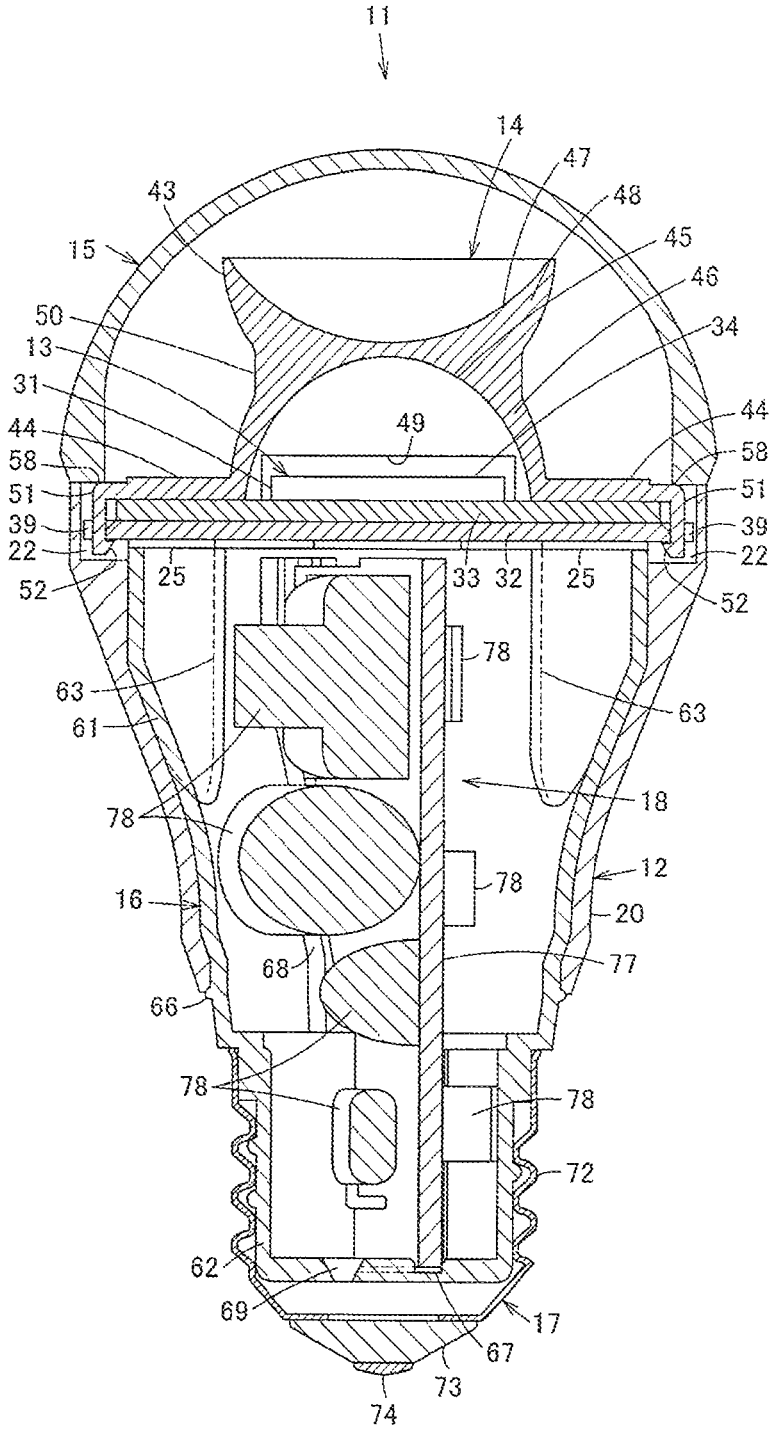
FIG. 1 is a cross sectional view of a self-ballasted lamp of an embodiment.
Figure 2:
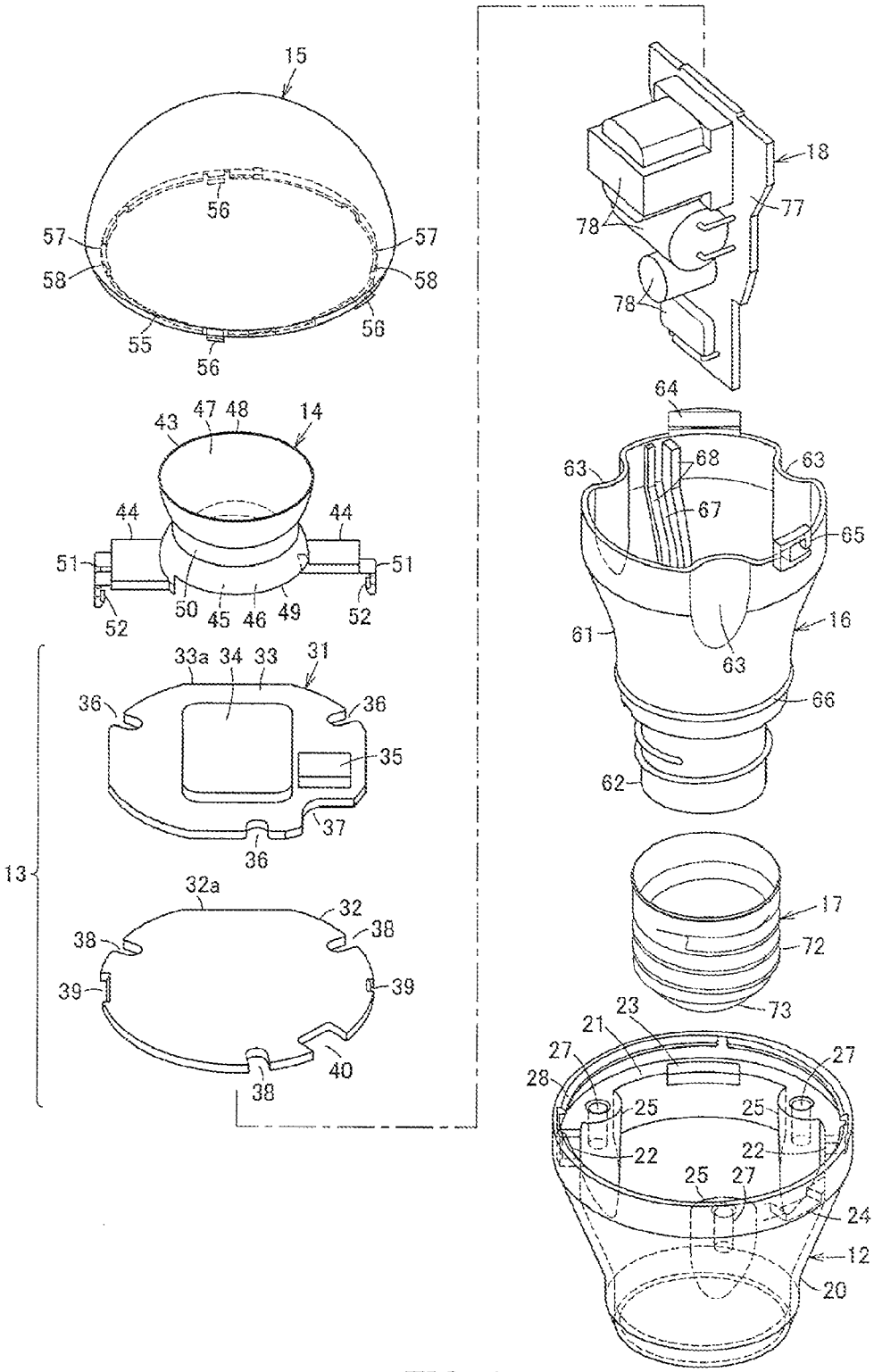
FIG. 2 is a perspective view of the disassembled self-ballasted lamp.
Figure 3:
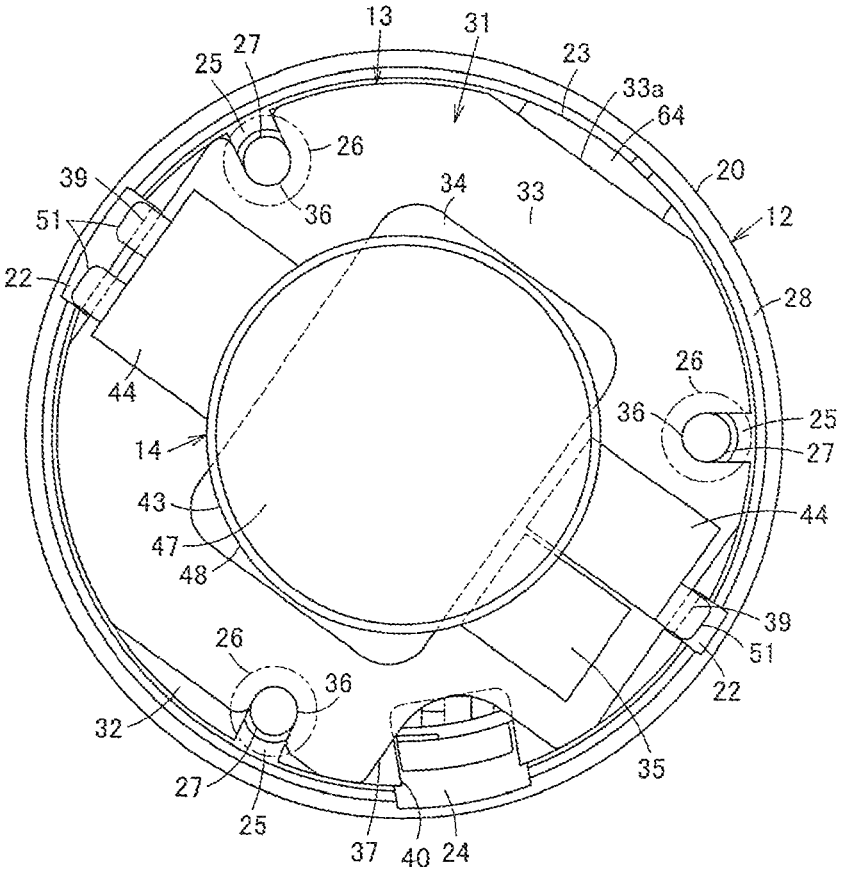
FIG. 3 is a plan view of the self-ballasted lamp from which a globe is removed.
Figure 4:
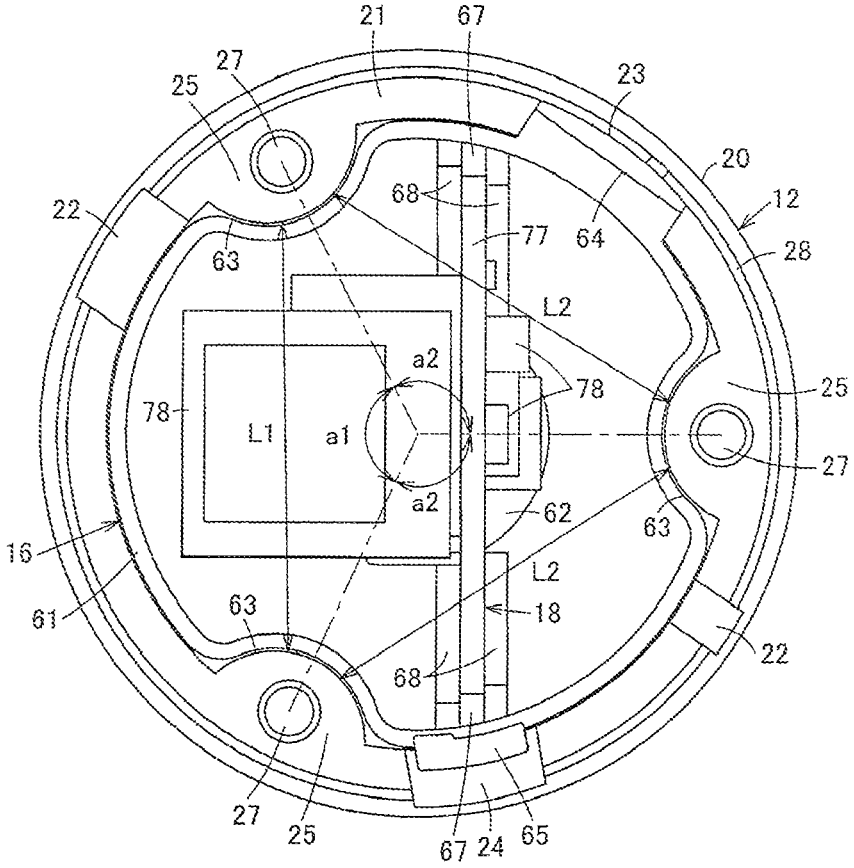
FIG. 4 is a plan view showing a base body, cover and lighting circuit of the self-ballasted lamp.

In FIGS. 1 and 2, the reference numeral 11 denotes a self-ballasted lamp as an illumination apparatus, and the self-ballasted lamp 11 includes a cylindrical base body 12, a light source unit 13 attached to one end side (one end side of a lamp axis connecting a globe and a cap of the self-ballasted lamp 11) of the base body 12, a lens 14 attached to the light source unit 13, a globe 15 which covers the light source unit 13 and the lens 14 and is attached to one end side of the base body 12, a cover 16 arranged in the base body 12, a cap 17 which is arranged on the other end side of the base body 12 and attached to the other end of the cover 16, and a lighting circuit 18 arranged in the cover 16. The self-ballasted lamp 11 has the same length in a lamp axis direction and outer diameter of a maximum diameter portion of the globe 15 as those of a mini krypton bulb, and is formed in a shape approximate to that of the mini krypton bulb.

As shown in FIGS. 1 to 4, the base body 12 is made of, for example, metal such as aluminum, or ceramics, excellent in thermal conductivity and radiation performance, and has a base body portion 20 which is formed in the shape of a cylinder of which the diameter becomes larger from the other end side toward one end side.

An annular attachment face 21, to which the light source unit 13 is attached, is formed, facing one end side of the base body 12, at an inner circumferential portion of one end side of the base body 12. On the attachment face 21, there are formed, a pair of lens attachment recess portions 22 positioned symmetrically with respect to the center of the base body 12, a cover attachment recess portion 23; and a wiring recess portion 24.

At the inner circumferential portion of one end side of the base body 12, a plurality of portions of an inner face of the base body 12 are projected and formed as boss portions 25 constituting a part of the attachment face 21. An attachment hole 27, into which a screw 26 for attaching the light source unit 13 is screwed, is formed in each boss portion 25. In the present embodiment, the three boss portions 25 are provided at unequal intervals in a circumferential direction of the base body 12, and one of three intervals between the adjacent boss portions 25 in the circumferential direction, an interval L1, is longer than the other two intervals L2. That is, one of the angles corresponding to the three intervals formed by the adjacent boss portions 25, an angle a1, is larger than the other angles a2. Moreover, the other two intervals L2 are equal, and also the two angles a2 are equal.

At the inner circumferential portion of one end side of the base body 12, a claw-shaped globe attachment portion 28 is formed to be projected to which the globe 15 is attached. The globe attachment portion 28 is formed to be notched corresponding to positions of the recess portions 22 and 24.

The thickness, except portions at which the boss portions 25 are located, of the base body portion 20 of the base body 12 is smaller than a thickness required for forming the attachment hole 27 into which the screw 26 is screwed, and, that is, smaller than the diameter of the boss portion 25 constituting the attachment hole 27. Thus, while an external form of the base body 12 is made as small as that of a mini krypton bulb, a space required for housing the lighting circuit 18, etc., is allocated inside the base body 12.

Moreover, for improvement in heat radiation performance, a surface of the base body 12 may be subjected to alumite treatment, or heat radiating fins may be provided on the surface.

The light source unit 13 is constituted by a light emitting module 31 and a heat conducting plate 32.

The light emitting module 31 has a disk-shaped substrate (module substrate) 33 formed of, for example, metal such as aluminum, or ceramics, excellent in thermal conductivity, a plane light source 34 as a light source formed on a center area of one surface of the substrate 33 and a connector 35 mounted on a peripheral area of one surface of the substrate 33.

The plane light source 34 has a light emitting face having a diameter of 2 mm or larger, and uses semiconductor light emitting elements such as LED elements or EL (electroluminescent) elements. In the embodiment, an LED element is used as the semiconductor light emitting element, and a COB (Chip On Board) method for mounting the plurality of LED elements on the substrate 33 is adopted. That is, the plurality of LED elements are mounted on the substrate 33, electrically connected in series to each other by wire bonding and integrally covered and sealed with a fluorescent layer composed of transparent resin such as silicon resin in which fluorescent material is mixed. For example, an LED element emitting blue light is used as the LED element, and fluorescent material, which is excited by a part of blue light emitted from the LED elements to emit yellow light, is contained in the fluorescent layer. Accordingly, the plane light source 34 is constituted by the LED elements, the fluorescent layer, etc., a surface of the fluorescent layer, which is a surface of the plane light source 34, serves as a light emitting surface, and white illumination light is emitted from the light emitting surface. Although the light emitting surface of the plane light source 34 is rectangularly formed in the present embodiment, the shape of the light emitting surface is not limited to a rectangle and may be a square, circle or the like.

A wiring pattern (not shown) is formed on one surface of the substrate 33, and the plurality of LED elements and the connector 35 are connected to the wiring pattern. In a peripheral portion of the substrate 33, a plurality of insertion holes 36, into which the screws 26 to be screwed into the boss portions 25 are inserted, are formed corresponding to positions of the boss portions 25 of the base body 12, and a notch portion 37 is formed corresponding to the position of the wiring recess portion 24 of the base body 12. The insertion hole 36 is formed as an insertion groove opened in an outer diameter direction of the substrate 33.

The heat conducting plate 32 is formed of, for example, metal such as aluminum, or ceramics, excellent in thermal conductivity, and the other surface of the substrate 33 of the light emitting module 31 is thermally conductively brought into contact with one surface of the heat conducting plate 32.

In a peripheral portion of the heat conducting plate 32, a plurality of insertion holes 38, into which the screws 26 to be screwed into the boss portions 25 are inserted, are formed corresponding to the positions of the boss portions 25 of the base body 12, a pair of recess-shaped lens attachment portions 39 for attaching the lens 14 is formed corresponding to the positions of the lens attachment recess portions 22 of the base body 12, and a notch portion 40 is formed corresponding to the position of the wiring recess portion 24 of the base body 12. The insertion hole 38 is formed as an insertion groove opened in an outer diameter direction of the heat conducting plate 32.

The heat conducting plate 32 is coupled to the substrate 33 of the light emitting module 31 so that the external form of the substrate 33 is smaller corresponding to the positions of each lens attachment position 39 of the heat conducting plate 32 and each lens attachment portion 39 projects from the substrate 33 in the outer diameter direction. A part of an outer portion of the heat conducting plate 32 is formed into a flat positioning surface 32*a*, and a part of an outer portion of the substrate 33 of light emitting module 31 is formed into a flat positioning surface 33*a*, the positioning surfaces 32*a* and 33*a* being aligned with each other in a state where the heat conducting plate 32 and the substrate 33 is normally coupled to each other with respect to the base body 12.

The lens 14 is integrally formed of transparent resin such as polycarbonate having a refractive index of 1.45 to 1.6, and has a lens body 43, which faces the plane light source 34 and controls light emitted from the plane light source 34, and a pair of attachment legs 44 for attaching the lens body 43 to the light source unit 13.

The lens body 43 has a first hemispherical shell-shaped lens portion 46 having a first recess portion 45 opened to one side in an optical axis direction in which light enters from the plane light source 34, that is, the other end side in the lamp axis direction, and a second hemispherical shell-shaped lens portion 48 having a second recess portion 47 opened to the other side in the optical axis direction, that is, one end side in the lamp axis direction, and one end side of the first lens portion 46 in the lamp axis direction and the other end side of the second lens portion 48 in the lamp axis direction are coupled and integrated with each other.

Each of the recess portions 45 and 47 of the lens portions 46 and 48 is constituted by an ellipsoid of revolution including a true circle and an ellipse, and each of the outer surface of the lens portions 46 and 48 is constituted by an ellipsoid of revolution similar to that of each of the recess portions 45 and 47. A groove-shaped cutout portion 49, which is placed away from the plane light source 34, is formed at an end, except portions at which the pair of attachment legs 44 is located, of the other end side of the first lens portion 46.

An integrating portion 50 for integrating the outer surfaces of the first lens portion 46 and the outer surfaces of the second lens portion 48 with each other is formed at a connecting section of the outer surfaces of the first lens portion 46 and the outer surfaces of the second lens portion 48. The integrating portion 50 is, so as to smoothly extend, formed with a combination of a plane surface, a curved surface or a combination of a plane surface and a curved surface, so that the connecting section of the outer surfaces of the first lens portion 46 and the outer surfaces of the second lens portion 48 is not formed of an acute angle.

Moreover, curvatures of hemispheroidal surfaces of recess portions 45 and 47 and outer surfaces of the lens portions 46 and 48, positions of the lens portions 46 and 48 in the lamp axis direction, the shape and size of the integrating portion 50 or the like are properly designed in accordance with required light distribution.

Each attachment leg 44 is, at the other end side of the first lens portion 46 in its axis direction, projected from positions, which are symmetrical with respect to the center axis of the lens 14, sideward orthogonally to the lamp axis direction, and brought into contact with and attached to one surface of the substrate 33 of the light emitting module 31. A pair of substantially L-shaped locking portions 51, which project to the other end in the lamp axis direction and are fitted into an outside surface of the lens attachment portion 39 of the heat conducting plate 32, are projected on a top end of each attachment leg 44, and a claw portion 52 to be hooked to the other surface of the heat conducting plate 32 is formed on a top end of the locking portion 51. Moreover, the locking portion 51 on each attachment leg 44 to be attached to the light source unit 13 is housed in the lens attachment recess portion 22 of the base body 12. Although one of the attachment legs 44 is wide and the two locking portions 51 are provided, the other attachment leg 44 is narrow and the one locking portion 51 is provided. Since the other attachment leg 44 is arranged aside of the connector 35 of the light emitting module 31, it is formed narrowly so as to be prevented from interfering with the connector 35.

Moreover, the lens body 43 of the lens 14 may be formed of glass. In this case, the attachment leg 44 may be separately formed as long as it holds the lens body 43.

The globe 15 is formed of, for example, synthetic resin or glass having transmittance and diffuseness of light, in the shape of a dome opened to the other end side in the lamp axis direction. At an opening edge of the other end side of the globe 15, a fitting portion 55 to be fitted inside the globe attachment portion 28 of the base body 12 is formed to be projected, and a plurality of locking claws 56 are formed which are secured to the globe attachment portion 28 with the fitting portion 55 fitted inside the globe attachment portion 28. A pair of positioning grooves 57, which engage with the locking portions 51 on the attachment legs 44 of the lens 14 to avoid the rotation of the globe 15 in relation to the base body 12, is formed on the fitting portion 55, and pressing portions 58, each of which comes into contact with the locking portion 51 on each attachment leg 44 of the lens 14 and presses each attachment leg 44 against the light source unit 13, are formed on the positioning groove 57. An outer diameter of the other end side, which is an opening side, of the globe 15 is formed so as to be larger than that of the base body 12.

The cover 16 is formed of, for example, insulating material such as PBT resin in the shape of a cylinder of which one end side in the lamp axis direction is opened and the other end side therein is closed. The cover 16 has a cover body 61 to be arranged inside the base body 12 and a cap attachment portion 62 which projects from the other end side of the base body 12.

The cover body 61 is formed, so as to be arranged along the inner surface of the base body 12, in a shape that is similar to that of the inner surface of the base body 12 and has a diameter transitionally larger toward one end side in the lamp axis direction, and a plurality of recess portions 63 into which the boss portions 25 of the base body 12 are fitted are formed on an outer face of the cover body 61. On the other end side of the cover body 61, a positioning portion 64 is projected which is fitted in the cover attachment recess portion 23 of the base body 12 and comes into contact with the positioning surfaces 33*a* and 32*a* of the substrate 33 and the heat conducting plate 32 of the light source unit 13 to position the substrate 33 and the heat conducting plate 32, and a wiring guide 65 is projected. A part of the other end of the cover body 61 is projected from the base body 12, and an annular locking portion 66 to be secured to the other end of the base body 12 is formed on an outer circumferential surface of the projected portion.

A pair of substrate attachment grooves 67 facing each other is formed along the lamp axis direction so as to extend over inner surfaces of the cover body 61 and the cap attachment portion 62. The pair of substrate attachment grooves 67 is formed at a position orthogonal to a wide area between the adjacent boss portions 25 of the base body 12 and at a position offset from the center of the cover 16 so as to be away from the wide area between the adjacent boss portions 25 of the base body 12. A pair of substrate holding portions 68 defining the substrate attachment groove 67 is formed on the inner surface of the cover body 61.

A pair of wiring holes 69 for connecting the cap 17 to the lighting circuit 18 with lead wires is formed in an end surface of the cap attachment portion 62.

The cap 17 is connectable to an E17 type socket for conventional illumination bulbs, and has a shell 72 screwed and fixed to a circumferential surface of the cap attachment portion 62 of the cover 16, an insulating portion 73 provided on the other end side of the shell 72, and an eyelet 74 provided on a top portion of the insulating portion 73.

The lighting circuit 18 is a circuit for supplying constant current to the LED elements of the light emitting module 31, and has a lighting circuit substrate 77 and a plurality of lighting circuit components 78 mounted on the lighting circuit substrate 77.

One surface of the lighting circuit substrate 77 serves as a mounting surface on which most of the lighting circuit components 78 are mounted, and the other surface of the lighting circuit substrate 77 serves as a wiring pattern surface on which a wiring pattern, to which the lighting circuit components 78 are electrically connected, is formed.

The lighting circuit substrate 77 is inserted from one end side of the cover 16 and held by fitting both ends of the lighting circuit substrate 77 in the substrate attachment grooves 67. Accordingly, the lighting circuit substrate 77 is vertically arranged in the cover 16 along the lamp axis direction, the mounting surface of the lighting circuit substrate 77 is made to face the wide area between the adjacent boss portions 25 of the base body 12, the wiring pattern surface of the lighting circuit substrate 77 is directed to the side facing the wide area between the adjacent boss portions 25 of the base body 12, and the lighting circuit substrate 77 is arranged at a position offset from the centers of the base body 12 and the cover 16 so that the distance between the mounting surface and an inner surface of cover 16 is longer than that between the wiring pattern surface and the inner surface of the cover 16.

The plurality of lighting circuit components 78, which are discrete components each having lead wires, are mounted on the mounting surface of the lighting circuit substrate 77. The lead wires of the lighting circuit component 78 penetrate the lighting circuit substrate 77 and are soldered and connected to the wiring pattern on the wiring pattern surface. As the lighting circuit components 78 mounted on the mounting surface of the lighting circuit substrate 77, there are used large components such as an electrolytic capacitor of a rectifying and smoothing circuit for rectifying and smoothing AC voltage, an inductor of a chopper circuit for converting rectified and smoothed voltage to a predetermined voltage and a resistor used for another circuit, as well as small components such as a switching element, a capacitor and a diode. Of the lighting circuit components 78 mounted on the mounting surface of the lighting circuit substrate 77, larger components are arranged on one end side where an inner diameter of the cover 16 is larger, and smaller components are arranged on the other end side where inner diameter of the cover 16 is smaller. The lighting circuit components 78 mounted on the mounting surface of the lighting circuit substrate 77 are arranged on the wide area between the adjacent boss portions 25 of the base body 12.

Of the other lighting circuit components 78, surface mount components are mounted on the wiring pattern surface of the lighting circuit substrate 77. The surface mount components include a chip resistor, a chip capacitor and the like.

An input side of the lighting circuit 18 is electrically connected to the shell 72 and eyelet 74 of the cap 17 via a lead wire for inputting (not shown) passing through the wiring hole 69 of the cover 16. An output side of the lighting circuit 18 is connected to the connector 35 of the lighting circuit module 31 via a lead wire for outputting having a connector (not shown).

In assembling the self-ballasted lamp 11, the lighting circuit 18 is inserted into the cover 16 from one end side of the cover 16, the lead wire for inputting inserted in the wiring hole 69 of the cover 16 is connected to the cap 17, and the cap 17 is attached to the cap attachment portion 62 of the cover 16.

The cover 16, in which the lighting circuit 18 and the cap 17 are installed, is inserted into the base body 12 from one end side of the base body 12, the other end side of the cover 16 having the cap 17 is projected from the other end side of the base body 12, the locking portion 66 of the cover 16 is secured to the other end of the base body 12, and the cover 16 is prevented from coming off from the base body 12. Here, each recess portion 63 of the cover 16 is aligned with and fitted onto each boss portion 25 of the base body 12, and the positioning portion 64 and wiring guide 65 of the cover 16 are aligned with and fitted into the recess portions 23 and 24 of the base body 12 respectively. Thus, the cover 16 can be aligned with and fitted into the base body 12 and the base body 12 avoids rotation of the cover 16 after fitting.

The heat conducting plate 32 and the substrate 33 of the light emitting module 31, which constitute the light source unit 13, are installed in order from one end side of the base body 12 having the cover 16, etc., and arranged on the attachment surface 21. Since the positioning portion 64 of the cover 16 installed in the base body 12 here projects from the attachment surface 21, the heat conducting plate 32 and the substrate 33 can be positioned and installed in the base body 12 by aligning the positioning surface 32*a* of the heat conducting plate 32 with the positioning surface 33*a* of the substrate 33 on the positioning portion 64. Thus, each insertion hole 38 of the heat conducting plate 32 and each insertion hole 36 of the substrate 33 are arranged coaxially with the attachment hole 27 of each boss portion 25 of the base body 12. Then, each screw 26 is screwed into the attachment hole 27 of each boss portion 25 through each insertion hole 36 of the substrate 33 and each insertion hole 38 of the heat conducting plate 32, the attachment face 21 of the base body 12, the heat conducting plate 32 and the substrate 33 are thermally conductively brought into close contact with each other, and the light source unit 13 is fixed to the base body 12.

The lead wire for outputting of the lighting circuit 18 is led out to one surface side of the light emitting module 31 through the notch portion 40 of the heat conducting plate 32, the notch portion 37 of the substrate 33 and the wiring guide 65 of the cover 16 in installing the light source unit 13 into the base body 12, and the connector provided at a top end of the lead wire is connected to the connector 35 of the light emitting module 31 after the light source unit 13 is installed in the base body 12.

The locking portion 51 on each attachment leg 44 of the lens 14 is inserted in each lens attachment portion 39 of the heat conducting plate 32 of the light source unit 13 through each lens attachment recess portion 22 of the base body 12, and the claw portion 52 on the locking portion 51 is hooked to secure to the other face of the heat conducting plate 32. Thus, the locking portion 51 on each attachment leg 44 of the lens 14 is fitted on each lens attachment portion 39 of the heat conducting plate 32, the lens 14 can be positioned parallel with surfaces of the substrate 33 and the heat conducting plate 32, the substrate 33 and the heat conducting plate 32 can be held between the attachment legs 44 and the claw portions 52, the lens 14 can be positioned perpendicular to the surfaces of the substrate 33 and the heat conducting plate 32, and the lens 14 can be reliably positioned and held on the light source unit 13. It is allowed that, by applying, for example, adhesive composed of silicon resin, cement or the like to each lens attachment recess portion 22 of the base body 12 or filling each recess portion 22 with adhesive, each attachment leg 44 of the lens 14 is adhered and fixed to the light source unit 13 and the base body 12. Additionally, the adhesive may be used as adhesive for attaching the globe 15 to the base body 12.

Adhesive composed of silicon resin, cement or the like is applied to an inner circumference of the globe attachment portion 28 of the base body 12, each positioning groove 57 of the globe 15 is positioned in the locking portion 51 on each attachment leg 44 of the lens 14, the globe 15 is adhered to the base body 12, and thus each locking claw 56 of the globe 15 is locked to the globe attachment portion 28 and the globe 15 is fitted and secured to the base body 12. Since a fitting locking structure is adopted for thus fixing the globe 15 to the base body 12, the amount of adhesive used in the case of using adhesive together with the structure can be further reduced compared with that of a conventional fixing method, or the globe 15 can be reliably fixed to the base body 12 even in the case of using only the structure. By attaching the globe 15 to the base body 12, the pressing portion 58 of the globe 15 is brought into contact with the locking portion 51 on each attachment leg 44 of the lens 14 and each attachment leg 44 is pressed against the light source unit 13.

Moreover, an assembling order of the self-ballasted lamp 11 is not limited to the above described order, and another assembling order is applicable.

Figure 5:
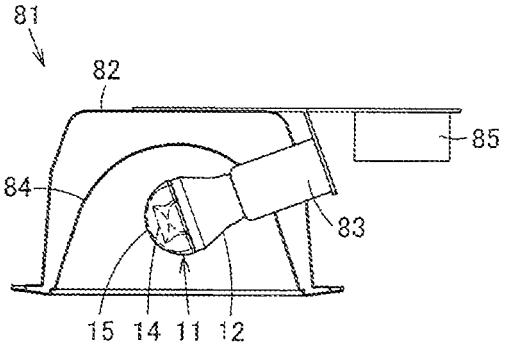
FIG. 5 is a cross sectional view of a lighting fixture using the self-ballasted lamp.

FIG. 5 shows a lighting fixture 81 which is a downlight using the self-ballasted lamp 11, the lighting fixture 81 has a fixture body 82, and there are disposed in the fixture body 82, a socket 83 to which the self-ballasted lamp 11 is configured to attach with the lamp axis obliquely laterally directed, and a reflector 84 for reflecting light, which is emitted from the self-ballasted lamp 11, downward. Moreover, the reference numeral 85 in FIG. 5 denotes a terminal block.

When the self-ballasted lamp 11 is attached to the socket 83 of the lighting fixture 81 and energized, the lighting circuit 18 is operated, power is supplied to the plurality of LED elements of the light emitting module 31, the LED elements are lit, light is emitted from the plane light source 34 and is entered into the lens 14, and light having distribution controlled by the lens 14 is emitted outward through the globe 15.

Heat generated when the plurality of LED elements of the light emitting module 31 are lit is mainly conducted to the heat conducting plate 32 through the substrate 33, conducted to the substrate 33 and conducted from the heat conducting plate 32 to the base body 12 and then radiated into air from the surface of the base body 12.

According to the self-ballasted lamp 11 of the present embodiment, since the claw portions 52 on the attachment legs 44 of the lens 14 are secured to the light source unit 13, it can be expected that the lens body 43 of the lens 14 can be easily arranged facing the plane light source 34 of the light source unit 13, a positional relationship between the plane light source 34 and the lens 14 can be adjusted and light distribution performance can be stabilized.

Since the attachment legs 44 of the lens 14 are adhered to the light source unit 13 by the adhesive and further the claw portions 52 are secured to the light source unit 13, the lens 14 can be more reliably fixed to the light source unit 13.

Since the pressing portions 58 of the globe 15 press the attachment legs 44 of the lens 14 against the light source unit 13 and further the claw portions 52 are secured to the light source unit 13, the lens 14 can be more reliably fixed to the light source unit 13.

When the lens body 43 of the lens 14 comes into contact with the plane light source 34, heat generated from the plane light source 34 is conducted to the lens body 43, the lens body 43 is raised in temperature and degradation such as yellowing is easily caused to the lens body 43. However, since the cutout portion 49 for preventing the lens body 43 of the lens 14 from coming into contact with the plane light source 34 is formed on the lens body 43 of the lens 14, degradation of the lens body 43 for controlling light emitted from the plane light source 34 can be reduced. In this case, since the attachment legs 44 of the lens 14 come into contact with the substrate 33 on which the plane light source 34 is mounted, it is easily affected by heat. However, since the attachment leg 44 does not affect the control of light, there is acceptable in yellowing. Additionally, yellowing of the attachment leg 44 has little influence on the lens body 43.

Moreover, the claw portion 52 on the attachment leg 44 of the lens 14 may be constituted to be secured not to the heat conducting plate 32 but to the other surface of the substrate 33.

The light source unit 13 is not always required to include the heat conducting plate 32 as long as it includes only the substrate 33. In the case of including only the substrate 33, the claw portion 52 on the attachment leg 44 of the lens 14 may be constituted to be secured to the other surface of the substrate 33.

The present embodiment can be applied to a self-ballasted lamp using an E26 type cap.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A self-ballasted lamp comprising:

a base body;

a light source unit including a light source comprising semiconductor light emitting elements arranged on a first side, the light source unit being attached to a first side of the base body;

a lens comprising:

a lens body disposed opposite the light source;

an attachment leg projected in a direction intersecting a light axis of the lens body and attached to a first side of the light source unit;

a substantially L-shaped locking portion projected along an end side of the light source unit at a tip of the attachment leg; and a claw portion formed on the end of the locking portion and hooked to a second side of the light source unit opposite the first side;

wherein the lens body, the attachment leg, the locking portion, and the claw portion are formed integrally with one another and the light source unit is disposed between the attachment leg and the claw portion;

a cap provided on a second side of the base body opposite the first side; and a lighting circuit arranged in a space within the base body and the cap.

2. The self-ballasted lamp according to claim 1, wherein the attachment leg is adhered to the light source unit.

3. The self-ballasted lamp according to claim 1, further comprising a globe including a pressing portion in contact with the locking portion, the globe covering the light source unit and the lens, the locking portion pressing the attachment leg against the light source unit and being attached to the first side of the base body.

4. A lighting fixture comprising:

a fixture body comprising a socket; and the self-ballasted lamp according to claim 1 and configured to attach to the socket.

5. The self-ballasted lamp according to claim 1, wherein:

the lens further comprises:

a second attachment leg projected in a direction intersecting the light axis of the lens body and attached to the first side of the light source unit;

a second substantially L-shaped locking portion projected along an end side of the light source unit at a tip of the second attachment leg; and a second claw portion formed on the end of the second locking portion and hooked to the second side of the light source unit; and the attachment leg and the second attachment leg are extendable and project from two sides of the lens body.

6. The self-ballasted lamp according to claim 5, wherein:

the light source unit comprises a pair of dimple like lens attachment portions;

the locking portion is fitted into one of the lens attachment portions; and the second locking portion is fitted into the other one of the lens attachment portions.

* * * * *